United States Patent [19]

Rutchik

[11] 4,102,068

[45] Jul. 25, 1978

[54] DISPLAY DEVICE

[75] Inventor: Robert K. Rutchik, Vernon Hills, Ill.

[73] Assignee: Rapid Mounting & Finishing Company, Chicago, Ill.

[21] Appl. No.: 778,369

[22] Filed: Mar. 17, 1977

[51] Int. Cl.[2] ..... G09F 11/00

[52] U.S. Cl. ..... 40/491; 40/509

[58] Field of Search ..... 40/36, 61, 63, 64, 65, 40/78

[56] References Cited

U.S. PATENT DOCUMENTS

| | | | |
|---|---|---|---|
| 2,117,187 | 5/1938 | MacLaren | 40/62 |
| 2,530,729 | 11/1950 | Reitz | 40/101 |
| 2,712,242 | 7/1955 | Davis | 74/22 |
| 3,080,668 | 3/1963 | Reali | 40/36 |
| 3,373,517 | 3/1968 | Halperin | 40/65 |
| 3,421,240 | 1/1969 | Bardi | 40/65 |
| 3,430,371 | 3/1969 | Phillips | 40/61 |
| 3,430,372 | 3/1969 | Rutchick | 40/61 |
| 3,774,330 | 11/1973 | Devanney | 40/36 |

*Primary Examiner*—John F. Pitrelli
*Assistant Examiner*—G. Lee Skillington
*Attorney, Agent, or Firm*—Wegner, Stellman, McCord, Wiles & Wood

[57] ABSTRACT

A display device arranged to present selectively three different displays. The displays are formed by three sets of display panels with two of the panel sets being selectively movable as a unit relative to the third and movable relative to each other and to the third to provide the selectively different panel displays. Selective movement of the panel sets is effected by a control which, in the illustrated embodiment, includes a camming element which is guided in a plurality of angularly related paths to effect the desired selective disposition of the different panel sets.

11 Claims, 8 Drawing Figures

FIG. 1
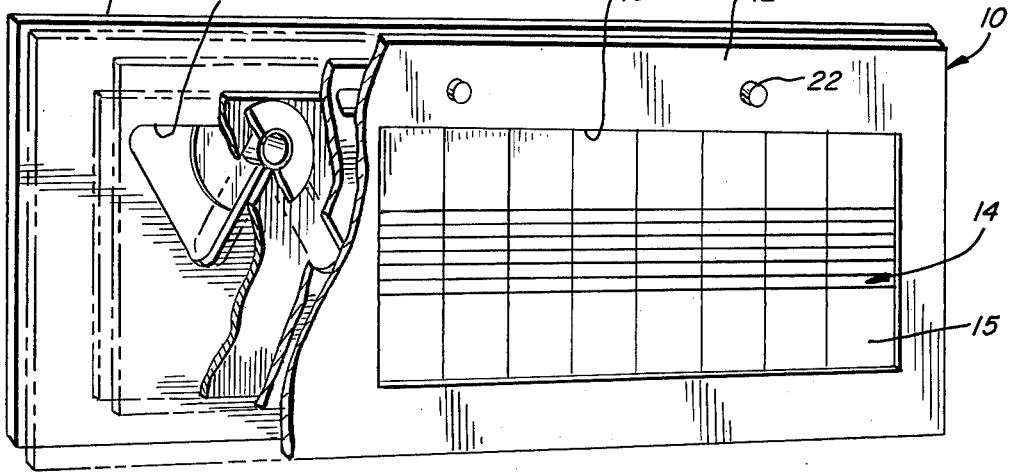
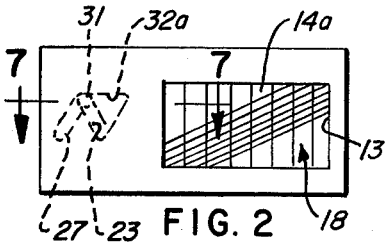
FIG. 2
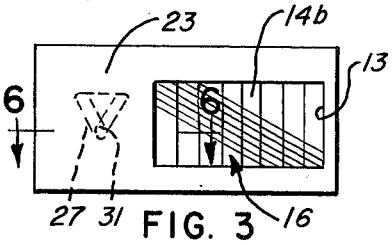
FIG. 3
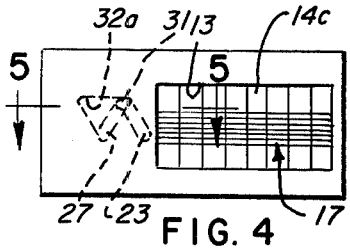
FIG. 4
FIG. 5
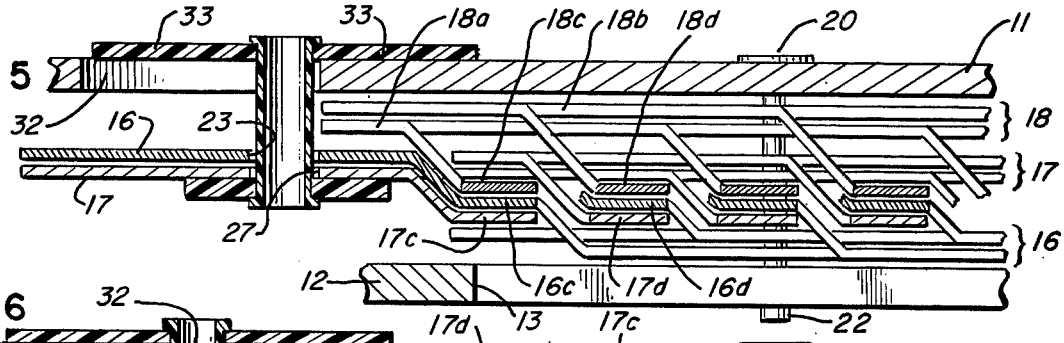
FIG. 6
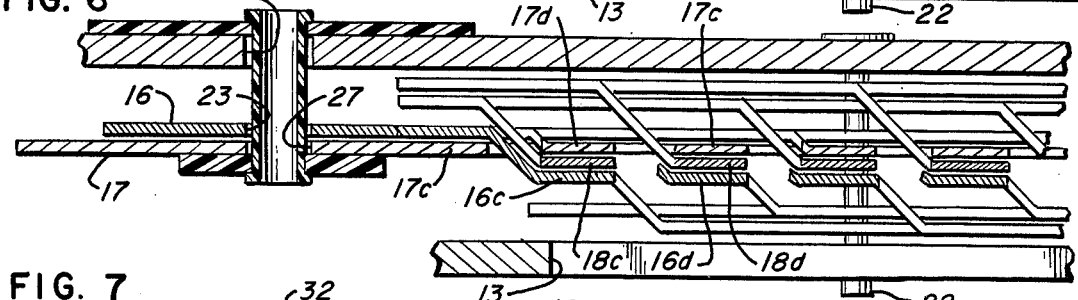
FIG. 7
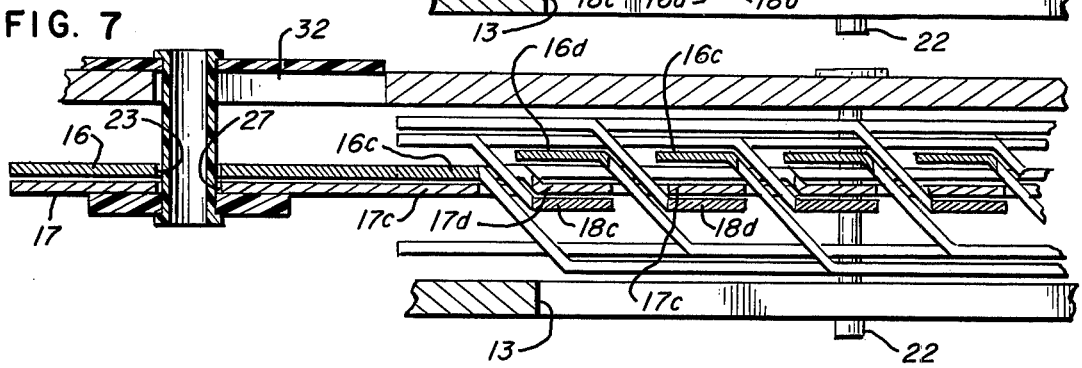

DISPLAY DEVICE

BACKGROUND OF THE INVENTION

1. Field of the Invention

This invention relates to display devices and in particular to display devices arranged to present selectively any one of a plurality of different displays by selective dispositioning of a plurality of different display panels.

2. Description of the Prior Art

In U.S. Pat. No. 3,430,372, of applicant, a display device with a reversible and replaceable four-message display cartridge is disclosed. The display cartridge includes a pair of display panels which are movable with respect to each other. The cartridge is reversible to provide, in total, four separate and distinct displays from the same side of the display device. Each of the display panels is made up of a pair of display members with the different display members being in sliding, face-abutting relationship.

A number of other display devices utilizing a plurality of panels have been developed. Illustratively, Archie E. Reitz, in U.S. Pat. No. 2,530,729, shows an animated display device wherein different cards leaf over to drop on top of an anchor card, which may comprise the top card of a series.

Rodolfo Reali, in U.S. Pat. No. 3,080,668, shows an advertising billboard showing a multiplicity of subjects wherein a plurality of strips are successively overlapped until all of the strips are successively shown.

In U.S. Pat. No. 3,373,517 of Jack S. Halperin, a changeable billboard sign is disclosed having a stationary frame, a movable frame, sign element anchoring means, a plurality of slatlike sign elements between the anchoring means, and a group of slatlike elements on one of the frames which is shorter than the first group.

Michael G. Bardi, in U.S. Pat. No. 3,421,240, shows a sign wherein different displays are obtained by covering an exposed portion of a stationary sign strip with a first movable sign strip, covering the exposed portion of the stationary sign strip with a second movable sign strip, and positioning the first and second movable sign strips behind the stationary sign strip. A cam is provided which is rotated to selectively move the first and second movable sign strips to provide a desired sequential display of the three different messages.

In U.S. Pat. No. 3,430,371, of John F. Phillips, an interleaved multiple sliding panel six-message display device is shown utilizing a number of different power driven means controlling movement of different pairs of panels thereof.

Raymond H. Devanney, in U.S. Pat. No. 3,774,330, shows a programmed display device having a plurality of image elements selectively exposed in accordance with a predetermined program by means of a motor and transmission means for transferring drive motion from the motor to the image elements.

Camming devices have been utilized for controlling positining of different elements as exemplified by the David G. Davis U.S. Pat. No. 2,712,242 disclosing a rotary plug valve having a three-lobed cam arrangement.

SUMMARY OF THE INVENTION

The present invention comprehends an improved display device which is extremely simple and economical of construction while yet providing facilitated three-image displays.

The device may be manually operable and of relatively small size and weight as desired.

More specifically, the display device of the present invention includes first, second and third display panels and control means for moving the first and second display panels as a unit with the first display panel overlying the second display panel selectively (a) to overlie the third display panel thereby to cause the device to display the first display panel, or (b) to underlie the third display panel thereby to cause the device to display the third display panel, and selectively providing relative movement between the first and second display panels to permit either of the first and second display panel to overlie the third display panel and the other of the first and second display panels thereby to cause the device to selectively display either of the first and second display panels.

In the illustrated embodiment, the control means comprises a camming element, means for guiding the camming element in first, second and third paths, and cam follower means on the first and second display panels (a) responsive to movement of the camming element in the first path to effect the movement of the first and second display panels as a unit, (b) responsive to movement of the camming element in the second path to move the first display panel independently of the second display panel to cause the first display panel to selectively overlie or underlie the third display panel, and (c) responsive to movement of the camming element in the third path to move the second display panel independently of the first display panel to cause the second display panel to selectively overlie to underlie the third display panel.

Further in the illustrated embodiment, each of the first and second display panels comprises a first plurality of substantially coplanar sections disposed in spaced edgewise juxtaposition, and a second plurality of substantially coplanar section disposed in spaced edgewise juxtaposition in substantially alternate coplanar relationship with the first plurality.

The different paths of movement of the camming element may be angularly related with one of the paths extending substantially parallel to the direction of movement of the display panels as a unit. In the illustrated embodiment, the paths are disposed at an angle of approximately 120° to each other.

BRIEF DESCRIPTION OF THE DRAWING

Other features and advantages of the invention will be apparent from the following description taken in connection with the accompanying drawing wherein:

FIG. 1 is a front perspective view with portions broken away of a display device embodying the invention;

FIG. 2 is a schematic front elevation illustrating a first display arrangement of the device;

FIG. 3 is a schematic front elevation illustrating a second display arrangement of the device;

FIG. 4 is a schematic front elevation illustrating a third display arrangement of the device;

FIG. 5 is a transverse section with the display device as arranged as shown in FIG. 4;

FIG. 6 is a transverse section with the display device as arranged as shown in FIG. 3;

FIG. 7 is a transverse section with the display device arranged as shown in FIG. 2.

DESCRIPTION OF THE PREFERRED EMBODIMENT

Figure 8:
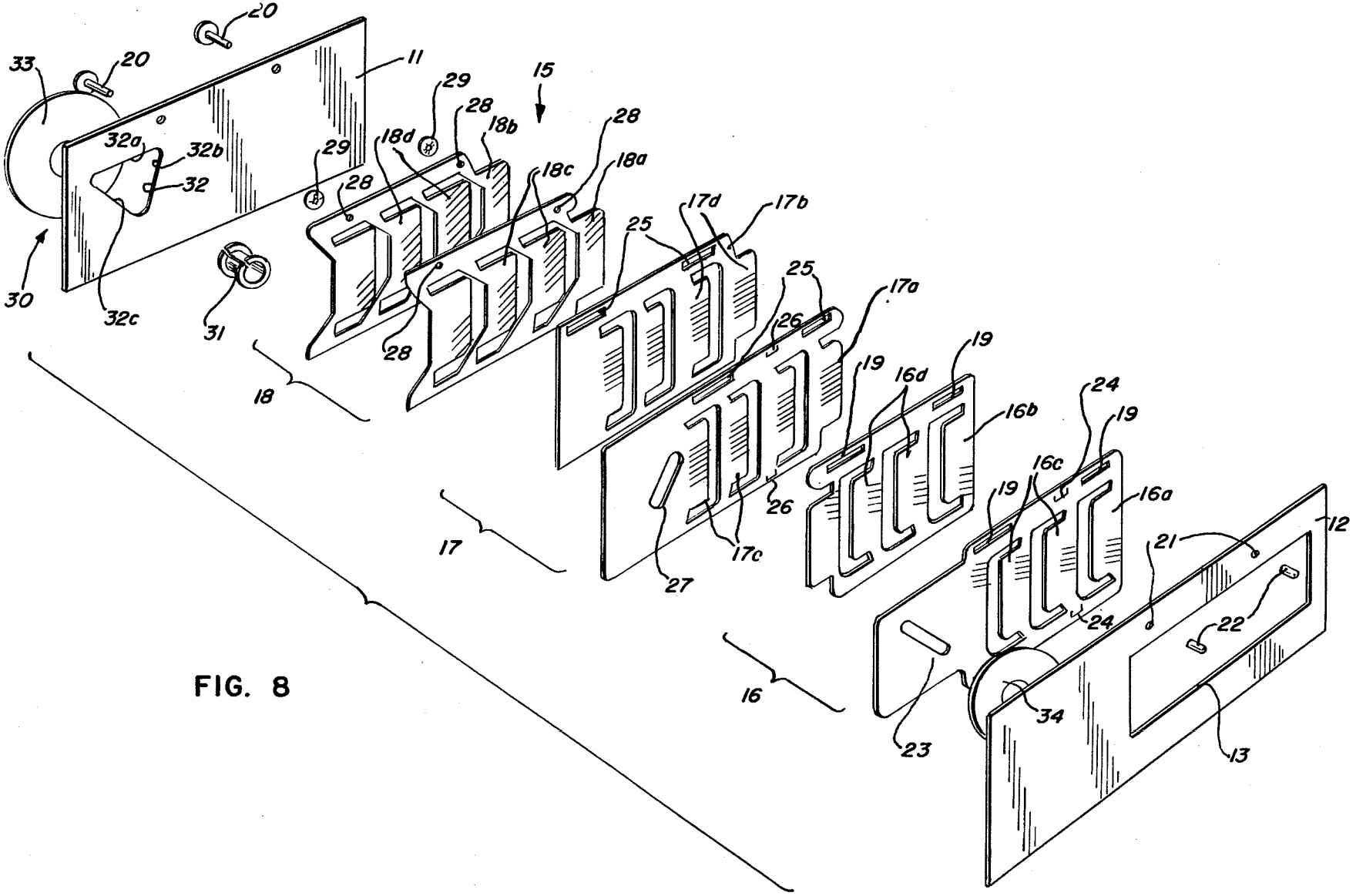
FIG. 8 is an exploded perspective view of the display device elements.

In the exemplary embodiment of the invention as disclosed in the drawing, a display device generally designated 10 is shown to comprise a base plate 11 and a cover plate 12. The cover plate defines a viewing opening 13 through which may be viewed any one of a plurality of different displays generally designated 14. The present invention comprehends such a display device wherein three displays are selectively presented at the opening 13, including display 14*a*, as shown in FIG. 4, 14*b* as shown in FIG. 3, and 14*c* as shown in FIG. 2. Each of the displays comprises an effectively continuous display presentation while being made up of a plurality of side-by-side juxtaposed elements generally designated 15.

Referring now more specifically to FIG. 8, the display elements 15 are defined by a first pair of display panels 16, a second pair of display panels 17, and a third pair of display panels 18.

As best seen in FIG. 8, display panels 16 comprise complementary panels 16*a* and 16*b*. Panel 16*a* includes a plurality of display sections 16*c* and panel 16*b* includes a plurality of display sections 16*d*. In the assembled relationship of display device 10, panel 16*a* is facially juxtaposed to panel 16*b* with the sections 16*c* and 16*d* interleaved, or overlapped, to provide the effectively continuous display 16 when exposed through the opening 13.

As further seen in FIG. 8, each of panel 16*a* and 16*b* is provided with a plurality of guide slots 19. Guide pins 20 are mounted to base plate 11 to extend forwardly therefrom through the guide slots 19 and a pair of complementary holes 21 in cover plate 12. Securing caps 22 may be provided on the projecting portions of the guide pins 20 to secure the cover plate to the base plate with the panels 16, 17 and 18 interposed therebetween.

As further seen in FIG. 8, panel 16*a* is provided with a cam follower slot 23.

Panel 16*a* may be fixedly secured to panel 16*b* as by suitable staples 24, or other suitable securing means as desired.

Thus, in the assembled arrangement of the display device, panels 16*a* and 16*b* define a plurality of overlapped sections secured in fixed relationship to each other to define the first display panel unit 16.

Second display panel unit 17 is comprised of a similar pair of facially juxtaposed panels 17*a* and 17*b* with panel 17*a* having a plurality of panel sections 17*c* and panel 17*b* having a plurality of panel sections 17*d* which are interleaved, or overlapped, with the sections 17*c*. Each of panels 17*a* and 17*b* is provided with a pair of guide slots 25 and the panels are secured together in facial juxtaposition by suitable securing means, such as staples 26.

Panel 17*a* is provided with a cam follower slot 27 which, as shown in FIG. 8, extends at an angle of approximately 120° to the cam follower slot 23 of panel 16*a*. Slot 27 is disposed to intersect slot 23 in the assembled arrangement of the display device. Guide slots 25 are disposed to be aligned with guide slots 19 with the guide pins 20 extending through the aligned guide slots.

Thus, panels 17*a* and 17*b* cooperatively define the second display panel 17 illustrated in FIG. 3 to be selectively viewed through the front opening 13.

The third display panel 18 is made up of a pair of panels 18*a* and 18*b*. Panel 18*a* is provided with a first plurality of display sections 18*c* and panel 18*b* is provided with a second plurality of display sections 18*d* which are interleaved, or overlapped, with sections 18*c* in the assembled facially juxtaposed disposition of the panels 18*a* and 18*b*.

Panels 18*a* and 18*b* are provided with a pair of holes 28 which are aligned with each other and with the guide pins 20 whereby the guide pins effectively retain the panels 18*a* and 18*b* against lateral movement in the display device. As shown, the guide pins 20 may be secured to the base plate 11 as by suitable locking nuts 29 interposed between panel 18*b* and the base plate.

In the assembled arrangement of the display device, panel 18*a* is facially juxtaposed to panel 18*b* whereby the overlapping panel sections 18*c* and 18*d* effectively define the display 18 when exposed through the front opening 13, as shown in FIG. 4 of the drawing.

In display device 10, the selective presentation of the display panels 16, 17 or 18 is effected by selective movement of the first and second panels 16 and 17 as a unit or independently selectively into overlying or underlying relationship with the panel 18. To effect such selective movement, a control means generally designated 30 is provided comprising a camming element 31 extending through a triangular opening 32 in the base plate 11. At its rear end, the camming element is provided with a locking disc 33 and at its front end the camming element is provided with a locking disc 34, locking disc 33 underlying the base plate 11, and locking disc 34 overlying panel 16*a* and underlying cover plate 12. Camming element 31 extends through slots 27 and 23 of panels 17*a* and 16*a*, respectively, and through opening 32 in the base plate 11 whereby movement of the camming element 31 transversely in the opening 32 effects a controlled movement of the panels 16 and 17. Thus, slots 27 and 23 function as cam follower slots in responding to selective positioning of the camming element 31. More specifically, the selective positioning of cam element 31 provides the different display arrangements seen in FIGS. 2, 3 and 4 by the selective movement of the panels 16 and 17 relative to the panel 18.

Further more specifically, camming element 31 may move selectively along each of the three sides 32*a*, 32*b* and 32*c* of the triangular opening 32 with the sides acting as guides for the camming element. By reference to FIG. 8, it may be readily seen that horizontal movement of the camming element as along edge 32*a* of the opening 32 effects a corresponding horizontal movement of panels 16 and 17 as a unit. Such movement of the panels may be best seen with reference to FIGS. 2 and 4. Thus, as shown therein, when the camming element 31 is disposed at the lefthand end of the upper edge 32*a*, the camming element will be at the upper end of the panel slots 27 and 23 with the panels 16 and 17 urged to the left as a unit to underlie the sections 18*c* and 18*d* of panel 18 whereby the display seen through opening 13 is the display of panel 18.

By moving the camming element 31 to the righthand end of the opening side 32*a*, the camming element is retained in the upper end of the slots 27 and 23 while carrying the panels 16 and 17 to the right as a unit whereby each of the panels 16 and 17 now overlies the panel 18. As panel 16 is uppermost, i.e. overlies panel 17, at this time, the display presented through opening 13 is that of panel 16, as shown in FIG. 4.

If it is desired to display panel 17, the user may move the camming element 31 downwardly along edge 32*b* of the opening 32 from the position of FIG. 4 to the lower position of the camming element shown in FIG. 3. In effecting such movement, the camming element 31 moves downwardly through the slot 26 without moving the panel 17 while, because of the opposite angular relationship of slot 23, moves panel 16 into underlying relationship with panel 18, and therefore panel 17 whereby panel 17 is presented at the opening 13, as shown in FIG. 3.

Similarly, in the arrangement of FIG. 2 wherein panel 18 is presented through the opening 13, should the user wish to display panel 17 next, he merely moves the camming element 31 downwardly along the edge 32*c* of opening 31 from the position of FIG. 2 to the position of FIG. 3, thereby moving the panel 17 outwardly from its underlying relationship with panel 18, as shown in FIG. 2, into its overlying relationship relative to panel 18, as shown in FIG. 3.

Thus, selective presentation of any of the three different panels 16, 17 and 18 is effected at opening 13 by the simple movement of the camming element 31 to the respective corners of the triangular opening 32. As indicated above, movement along the side 32*a* effects concurrent movement of both panels 16 and 17 as a unit, and movement along either of the edges 32*b* or 32*c* effects relative movement of panels 16 and 17.

As each of the panel sections overlap in the different dispositions of the panels as shown in FIGS. 2, 3 and 4, movement of the panels relative to each other is smoothly and easily effected by the simple guided movement of the camming element 31 as discussed above. As shown in FIGS. 5–7, the panel sections are effectively interleaved with the individual panels of the panel pairs being facially juxtaposed so as to effectively define substantially coplanar arrangements of the panel sections.

In the illustrated embodiment, the camming element 31 and discs 33 and 34 are formed of a relatively low friction plastic material to facilitate the camming action.

While the panel device 10 is extremely simple and economical of construction, it provides improved accurate presentation of the three different panels as shown in FIGS. 2, 3 and 4 by the simple manual movement of the camming element with the desired presentation being readily selected by the user by suitable facilitated guiding of the camming element in the triangular opening 32.

The foregoing disclosure of specific embodiments is illustrative of the broad inventive concepts comprehended by the invention.

I claim:

1. In an interleaving display device having first and second movable display panels and a third fixed display panel capable of being positioned selectively in any one of a plurality of different configurations including a first configuration wherein said first panel overlies said second panel that in turn overlies said third panel so as to display said first panel, a second configuration wherein said second panel overlies said third panel that in turn overlies said first panel so as to display said second panel, and a third configuration wherein said third panel overlies said first panel that in turn overlies said second panel so as to display said third panel, the improvement comprising control means for effecting a direct repositioning from any one of said configurations to either of the other two configurations.

2. The display device of claim 1 wherein said control means comprises a manually operable means.

3. The display device of claim 1 wherein each of said display panels comprises a plurality of substantially coplanar sections disposed in spaced edgewise juxtaposition.

4. The display device of claim 1 wherein said control means comprises a camming element, means for guiding said camming element in first, second and third paths, and cam follower means on said first and second display panels (a) responsive to movement of said camming element in said first path to effect said movement of the first and second display panels as a unit, (b) responsive to movement of said camming element in said second path to move said first display panel independently of said second display panel to cause said first display panel to selectively overlie or underlie said third display panel, and (c) responsive to movement of said camming element in said third path to move said second display panel independently of said first display path to cause said second display panel to selectively overlie or underlie said third display panel.

5. The display device of claim 1 wherein each of said first and second display panels comprises a first plurality of substantially coplanar sections disposed in spaced edgewise juxtaposition, and a second plurality of substantially coplanar sections disposed in spaced edgewise juxtaposition, said first plurality of display panels being disposed in alternate overlying relationship with said second plurality of display panels.

6. The display device of claim 1 wherein each of said first and second display panels comprises a first plurality of substantially coplanar sections disposed in spaced edgewise juxtaposition, and a second plurality of substantially coplanar sections disposed in spaced edgewise juxtaposition, said first plurality of display panels being fixedly secured to said second plurality of display panels to be disposed in alternate overlying relationship with said second plurality of display panels.

7. In an interleaving display device having first and second movable display panels and a third fixed display panel capable of being positioned selectively in any one of a plurality of different configurations including a first configuration wherein said first panel overlies said second panel that in turn overlies said third panel so as to display said first panel, a second configuration wherein said second panel overlies said third panel that in turn overlies said first panel so as to display said second panel, and a third configuration wherein said third panel overlies said first panel that in turn overlies said second panel so as to display said third panel, improved control means for effecting a direct repositioning from any one of said configurations to either of the other two configurations, comprising:

a camming element;

means for guiding said camming element in first and second paths; and cam follower means on said first and second display panels responsive to movement of said camming element in said path to effect said selective movements of said first and second display panels as a unit when said camming element is moved in said first path and relative to each other when said camming element is moved in said second path.

8. The display device of claim 7 wherein said camming element comprises manually operable means.

9. The display device of claim 7 wherein said guiding means comprises means for guiding said camming element further in a third path, said first, second and third paths comprising 120° angularly related paths, said cam follower means being (a) responsive to movement of said camming element in said first path to effect said movement of the first and second display panels as a unit, (b) responsive to movement of said camming element in said second path to move said first display panel independently of said second display panel to cause said first display panel to selectively overlie or underlie said third display panel, and (c) responsive to movement of said camming element in said third path to move said second display panel independently of said first display path to cause said second display panel to selectively overlie or underlie said third display panel.

10. The display device of claim 7 wherein said guiding means comprises means for guiding said camming element further in a third path, said first, second and third paths, said cam follower means being (a) responsive to movement of said camming element in said first path to effect said movement of the first and second display panels as a unit, (b) responsive to movement of said camming element in said second path to move said first display panel independently of said second display panel to cause said first display panel to selectively overlie or underlie said third display panel, and (c) responsive to movement of said camming element in said third path to move said second display panel independently of said first display path to cause said second display panel to selectively overlie or underlie said third display panel, said first path extending parallel to the direction of movement of said first and second display panel in selectively overlying and underlying said third display panel and said second and third paths being angularly directed relative to said direction of movement.

11. The display device of claim 7 further including a fixed guide adjacent said first and second display panels, and shoulder means on said first and second display panels cooperating with said fixed guide for further guiding said selective movement of the first and second display panels.

* * * * *